US010247178B2

(12) United States Patent
Sink et al.

(10) Patent No.: US 10,247,178 B2
(45) Date of Patent: Apr. 2, 2019

(54) VARIABLE DISPLACEMENT AXIAL PISTON PUMP WITH FLUID CONTROLLED SWASH PLATE

(71) Applicant: Robert Bosch GmbH, Stuttgart (DE)

(72) Inventors: Nathan Sink, Gray Court, SC (US); Michael Weathersbee, Ware Shoals, SC (US)

(73) Assignee: Robert Bosch GmbH, Stuttgart (DE)

( * ) Notice: Subject to any disclaimer, the term of this patent is extended or adjusted under 35 U.S.C. 154(b) by 322 days.

(21) Appl. No.: 15/082,439

(22) Filed: Mar. 28, 2016

(65) Prior Publication Data

US 2017/0276124 A1 Sep. 28, 2017

(51) Int. Cl.
*F04B 1/12* (2006.01)
*F04B 1/20* (2006.01)
(Continued)

(52) U.S. Cl.
CPC ..... *F04B 1/324* (2013.01); *F04B 1/126* (2013.01); *F04B 1/2042* (2013.01);
(Continued)

(58) Field of Classification Search
CPC .. F04B 1/146; F04B 1/148; F04B 1/34; F04B 1/20; F04B 1/2078; F04B 1/22;
(Continued)

(56) References Cited

U.S. PATENT DOCUMENTS 2,383,093 A 8/1945 Wahlmark
4,026,195 A * 5/1977 Forster ..... F01B 3/0064 91/506
(Continued)

FOREIGN PATENT DOCUMENTS

DE 2733870 3/1978
DE 10055262 5/2002
(Continued)

OTHER PUBLICATIONS

English Abstract of JP59092197A dated May 28, 1984 (Year: 1984).*
(Continued)

*Primary Examiner* — Nathan C Zollinger
(74) *Attorney, Agent, or Firm* — Michael Best & Friedrich LLP

(57) ABSTRACT

A variable displacement axial piston pump including a cylinder block defining a plurality of cylinder bores, each receiving a piston. A swash plate having a piston-supporting surface is pivotally supported relative to the cylinder block. A port block defines first and second pumping ports arranged in fluid communication with the plurality of cylinder bores such that, during operation of the pump, one of the first and second pumping ports is configured to supply fluid to the cylinder bores for pumping, and the other of the first and second pumping ports is configured to receive fluid pumped from the plurality of cylinder bores. The swash plate partially defines at least one variable volume control chamber, and the swash plate is operable to tilt with respect to the port block in response to a fluid pressure change in the at least one control chamber.

20 Claims, 14 Drawing Sheets

(51) Int. Cl.

| | |
|---|---|
| ***F04B 1/22*** | (2006.01) |
| ***F04B 1/32*** | (2006.01) |
| ***F04B 19/22*** | (2006.01) |
| ***F04B 23/06*** | (2006.01) |
| ***F04B 49/00*** | (2006.01) |
| ***F04B 49/06*** | (2006.01) |
| ***F04B 49/12*** | (2006.01) |
| ***F04B 49/22*** | (2006.01) |
| ***F04B 53/14*** | (2006.01) |

(52) U.S. Cl.
CPC ..... *F04B 1/2078* (2013.01); *F04B 1/22* (2013.01); *F04B 19/22* (2013.01); *F04B 23/06* (2013.01); *F04B 49/002* (2013.01); *F04B 49/06* (2013.01); *F04B 49/125* (2013.01); *F04B 49/22* (2013.01); *F04B 53/14* (2013.01)

(58) Field of Classification Search
CPC .... F04B 1/126; F04B 1/30; F04B 1/32; F04B 1/324; F04B 1/2042; F04B 19/22; F04B 23/06; F04B 49/06; F04B 49/22; F04B 49/125; F04B 53/14; F04B 49/002
See application file for complete search history.

(56) References Cited

U.S. PATENT DOCUMENTS

| | | | | |
|---|---|---|---|---|
| 4,157,233 | A * | 6/1979 | Horiuchi | F04B 49/08 417/218 |
| 4,232,587 | A | 11/1980 | Kline | |
| 5,678,405 | A | 10/1997 | Folsom | |
| 6,155,798 | A | 12/2000 | Deininger et al. | |
| 6,375,433 | B1 | 4/2002 | Du et al. | |
| 6,829,980 | B2 | 12/2004 | Sugiura et al. | |
| 6,848,262 | B2 | 2/2005 | Nosaka | |
| 7,559,208 | B2 | 7/2009 | Ota et al. | |
| 8,292,596 | B2 | 10/2012 | Ota et al. | |
| 8,714,938 | B2 | 5/2014 | Okuda et al. | |
| 8,882,474 | B2 | 11/2014 | Ota et al. | |
| 9,115,770 | B2 | 8/2015 | Kadlicko | |
| 2009/0031892 | A1 * | 2/2009 | Jacobs | F04B 1/2078 91/499 |
| 2016/0131118 | A1 * | 5/2016 | Weathersbee | F04B 1/2064 92/13 |

FOREIGN PATENT DOCUMENTS

| | | | | |
|---|---|---|---|---|
| DE | 102011105544 | A1 * | 1/2012 | F04B 1/324 |
| EP | 0308508 | | 3/1989 | |
| EP | 2767713 | | 8/2014 | |
| JP | 59092197 | A * | 5/1984 | B30B 1/266 |

OTHER PUBLICATIONS

Rexroth, Bosch Group "Axial Piston Variable Double Pump A20VG/A22VG, Data sheet" <http://dc-america.resource.bosch.com/media/us/products_13/product_groups_1/mobile_hydraulics_4/pdfs_6/ra-a93220_2010-10.pdf> 2010 (28 pages).
Rexroth, Bosch Group "Axial Piston Variable Pump A4VG (US-Version), Data sheet" <http://dc-america.resource.bosch.com/media/us/products_13/product_groups_1/industrial_hydraulics_5/pdfs_4/ra-a92004.pdf> publicly available prior to Mar. 28, 2016 (68 pages).
Eaton, Medium Duty Piston Pump, "Repair Information, Model 72400 Servo Controlled Piston Pump" <http://www.eaton.com/ecm/groups/public/@pub/@eaton/@hyd/documents/content/pll_1479.pdf> 1993 (25 pages).
Rexroth, Bosch Group "Axial Piston Variable Pump A10VG, Data sheet" <http://www.pressoil.it/wp-content/uploads/2014/05/A10VG-re92750_2009-06.pdf> publicly available prior to Mar. 28, 2016 (44 pages).
Danfoss, "Basic Information, H1 Axial Piston Pumps, Single and Tandem" <http://files.danfoss.com/documents/H1%20Single%20and%20Tandem%20Axial%20Piston%20Pumps,%20Basic%20Information/11062168.pdf> 2015 (40 pages).
Linde, "MPV/R-01 Medium Duty, Variable and Regulating Pumps for closed and open loop" <http://www.s3mm.com/catalogue/05_MPV_R_01_e.pdf> publicly available prior to Mar. 28, 2016 (35 pages).
International Search Report for Application No. PCT/EP2017/052262 dated May 12, 2017 (4 pages).

* cited by examiner

VARIABLE DISPLACEMENT AXIAL PISTON PUMP WITH FLUID CONTROLLED SWASH PLATE

BACKGROUND

The present invention relates to axial piston pumps. Such hydraulic pumps can be found in the traction drive system of skid steer construction vehicles and the like. A swash plate is mechanically tilted by a control piston to set a swash plate angle that controls the piston stroke and, therefore, the pump displacement.

SUMMARY

In one aspect, the invention provides a variable displacement axial piston pump. The axial piston pump includes a pump housing and a cylinder block defining a plurality of cylinder bores. The cylinder block defines a central axis about which the plurality of cylinder bores are arranged, and the cylinder block is supported for rotation relative to the pump housing about the central axis. Each of a plurality of pistons is received in a respective one of the plurality of cylinder bores. A swash plate is pivotally supported relative to the cylinder block, the swash plate providing a piston-supporting surface along which the plurality of pistons slide during operation of the pump. A port block defines first and second pumping ports arranged in fluid communication with the plurality of cylinder bores such that, during operation of the pump when the swash plate piston-supporting surface defines an angle other than 90 degrees with respect to the central axis, one of the first and second pumping ports is configured to supply fluid to the plurality of cylinder bores for pumping by the plurality of pistons as the cylinder block rotates, and the other of the first and second pumping ports is configured to receive fluid pumped from the plurality of cylinder bores by the plurality of pistons as the cylinder block rotates. The swash plate partially defines at least one variable volume control chamber, and the swash plate is operable to tilt with respect to the port block in response to a fluid pressure change in the at least one control chamber.

In another aspect, the invention provides a variable displacement axial piston pump including a cylinder block defining a plurality of cylinder bores. Each of a plurality of pistons is received in a respective one of the plurality of cylinder bores. Each piston of the plurality of pistons is a hollow piston having an axial through bore. A port block defines first and second pumping ports, one of the first and second pumping ports being configured to supply fluid to the plurality of pistons and the other of the first and second pumping ports being configured to receive fluid from the plurality of pistons. A swash plate is arranged between the port block and the cylinder block for supporting the plurality of pistons in sliding relationship along a piston-supporting surface. The swash plate defines first and second fluid passages operable to receive pumped fluid flow. The first fluid passage is permanently fluidly coupled to the first pumping port and in intermittent fluid communication with each of the plurality of cylinder bores through the respective piston axial through bores. The second fluid passage is permanently fluidly coupled to the second pumping port and in intermittent fluid communication with each of the plurality of cylinder bores through the respective piston axial through bores. At least one variable volume control chamber is defined between the swash plate and the port block. The swash plate is operable to tilt with respect to the port block, for varying a stroke length of the plurality of pistons, in response to a fluid pressure change in the at least one control chamber.

Other aspects of the invention will become apparent by consideration of the detailed description and accompanying drawings.

Figure 1:
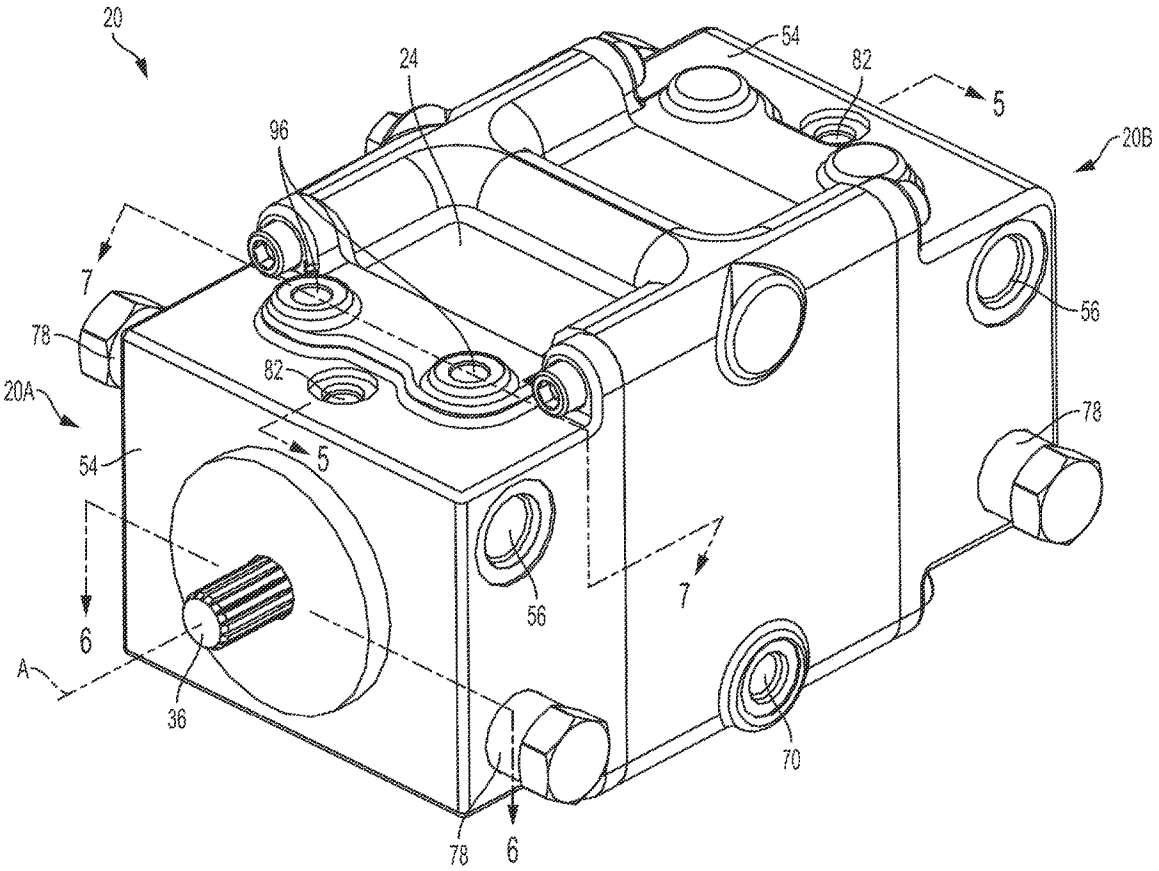
FIG. 1 is a perspective view of a variable displacement axial piston pump according to one exemplary construction.
Figure 2:
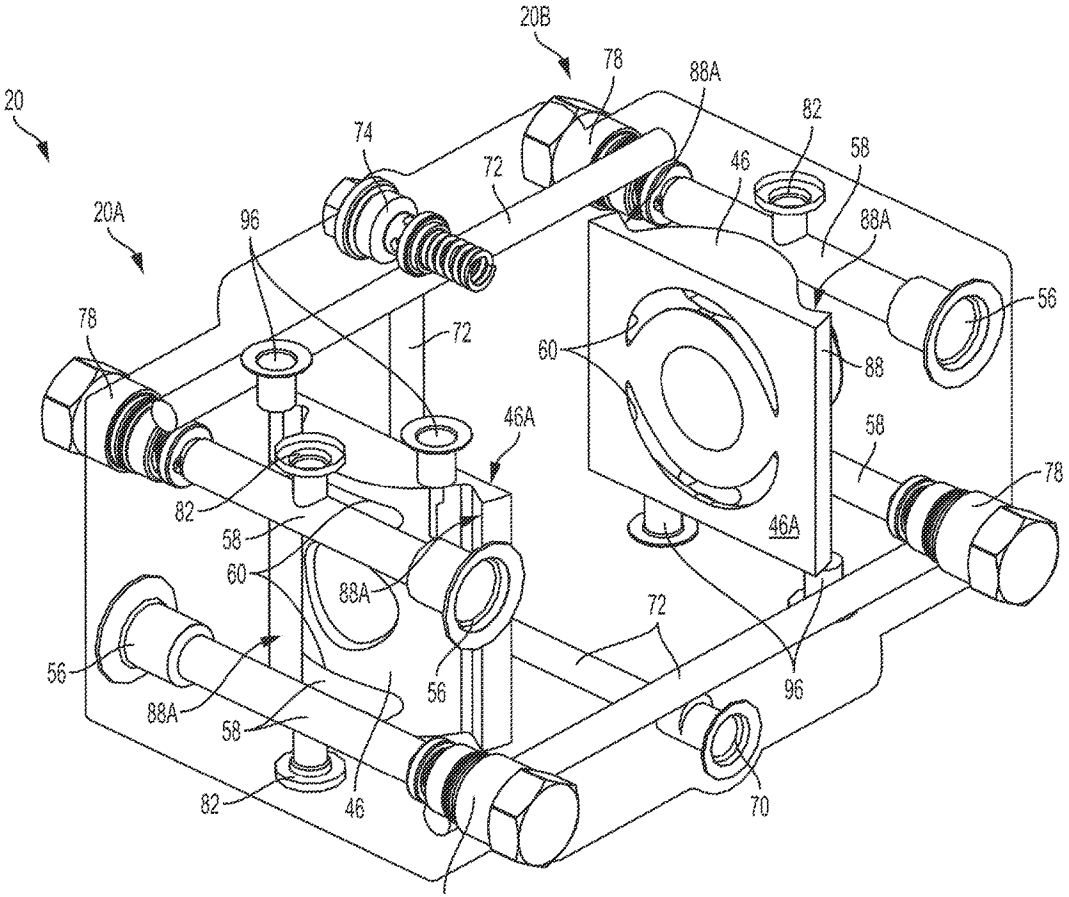
FIG. 2 is a perspective view of the pump of FIG. 1, in which the exterior material is made transparent and a majority of the pumping components are omitted so that the view instead shows a number of internal fluid passages.
Figure 3:
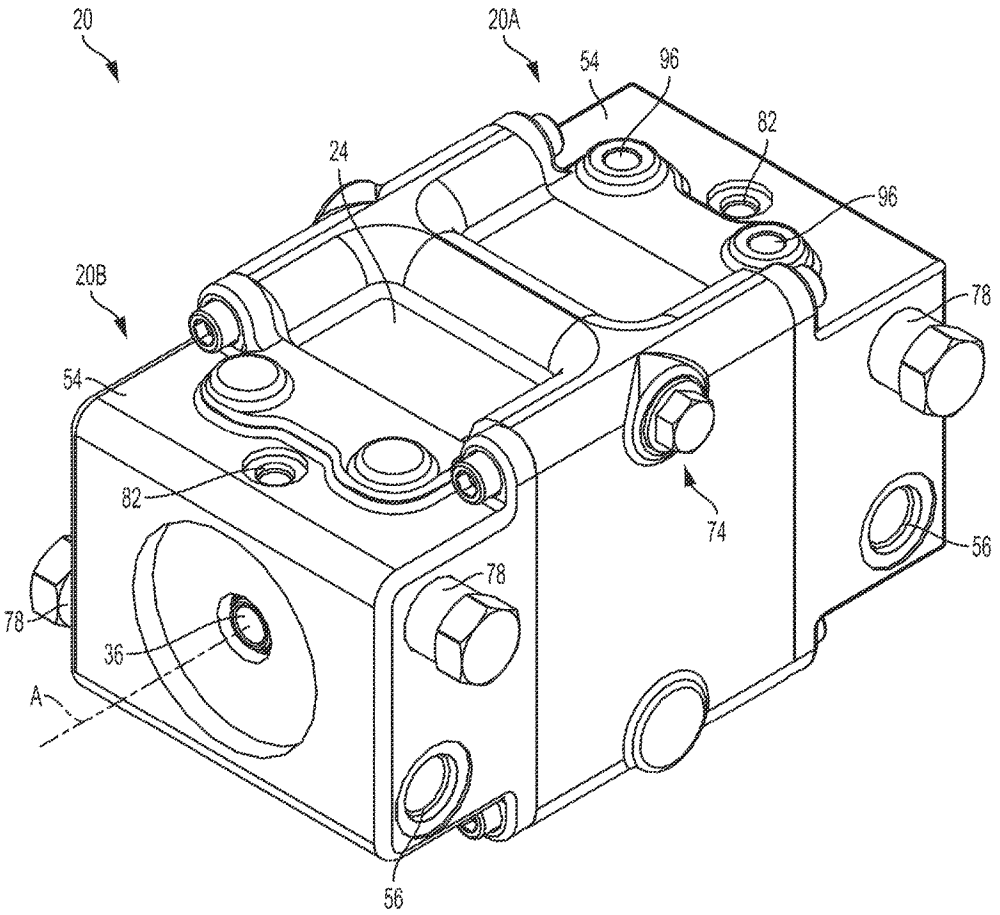
FIG. 3 is an alternate perspective view of the pump of FIGS. 1 and 2.
Figure 4:
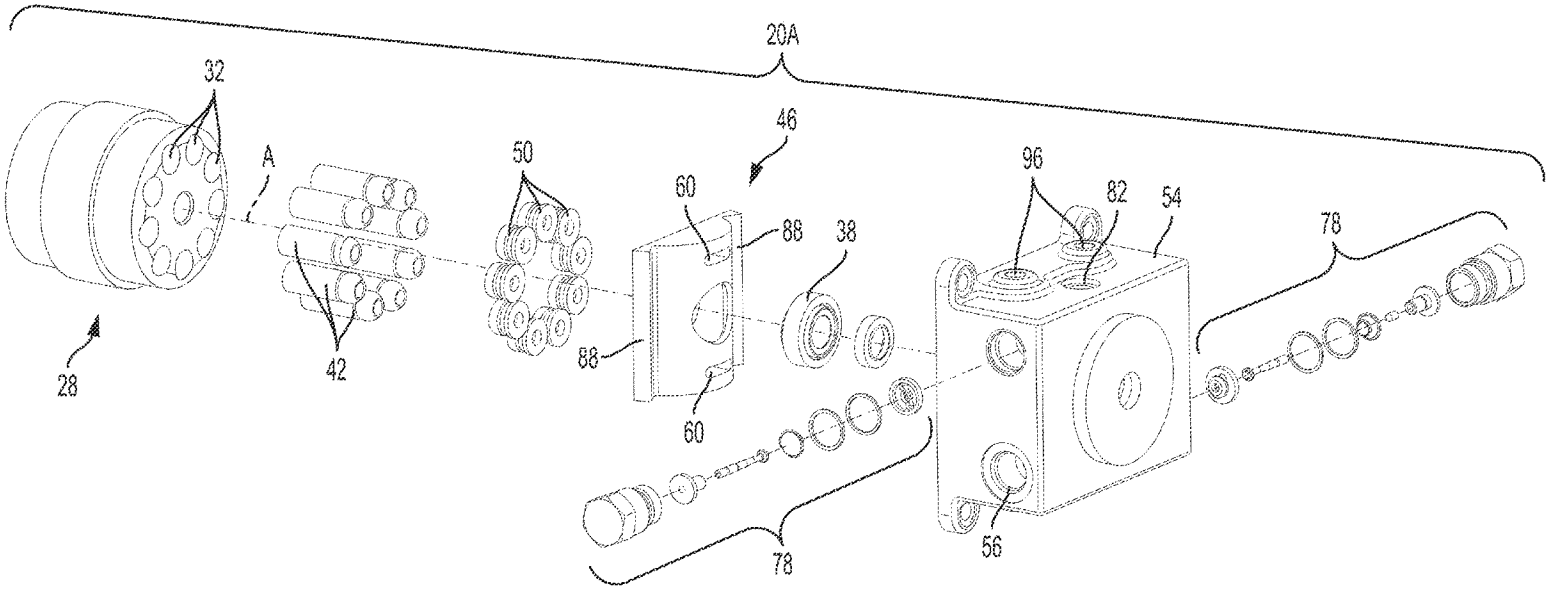
FIG. 4 is an exploded assembly view of part of the pump of FIGS. 1-3, illustrating one of the pumping units.
Figure 5:
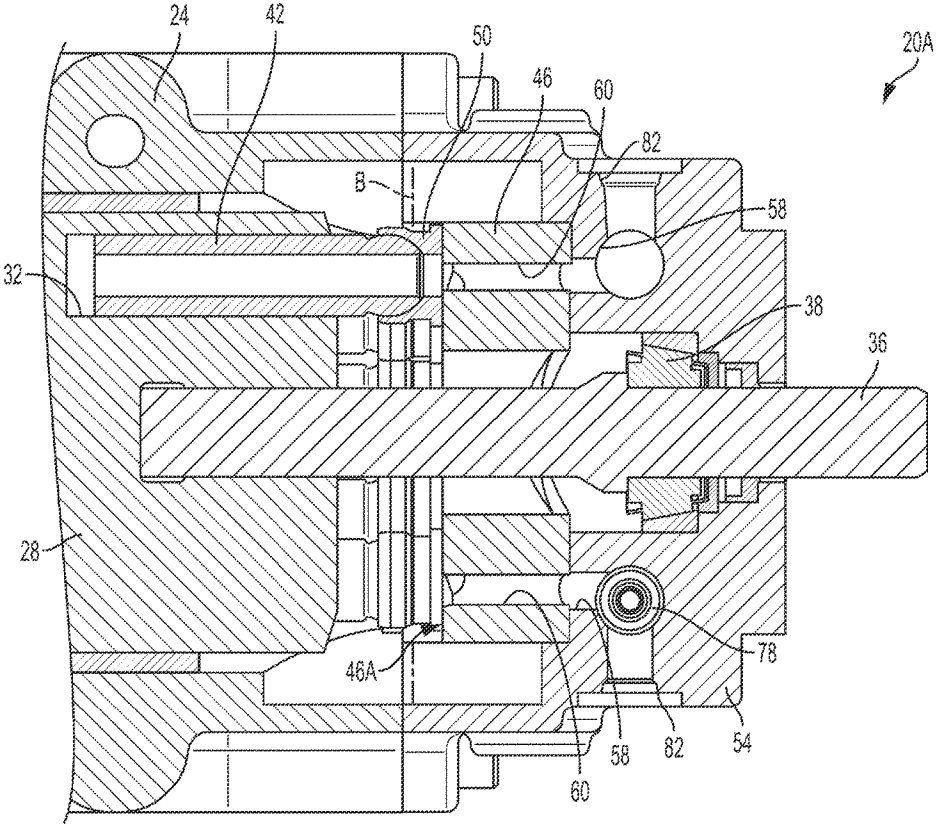
FIG. 5 is a cross-section view of the pump, taken along line 5-5 of FIG. 1.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

FIGS. 1-7 illustrate a variable displacement axial piston pump 20, which may be referred to herein as pump 20 for convenience. The pump 20 includes a pump housing 24 positioned radially outside of a cylinder block 28 defining therein at least one group or plurality of cylinder bores 32, each extending parallel to each other and all arranged at a common radius from a central axis A. The cylinder block 28 is supported for rotation relative to the pump housing 24 about the central axis A (e.g., by one or more shafts 36 and one or more bearings 38). At least one group or plurality of pistons 42 is provided such that each piston is received in a respective one of the cylinder bores 32 to reciprocate therein. As shown, the pump 20 is a tandem pump, consisting of two independent pump units 20A, 20B. Although the two pump units 20A, 20B share a common cylinder block 28, the cylinder bores 32 are provided in two separate groups, extending into the cylinder block 28 from opposite ends. Further, the cylinder bores 32 of a first one of the pump units 20A are not in fluid communication with the cylinder bores 32 of the second pump unit 20B. As such, the fluid pumping action of each pump unit 20A can be separately and independently controlled despite that the two pump units 20A, 20B are fixed for rotation together at a common speed.

To vary the displacement, each of the pump units 20A, 20B is provided with a respective swash plate 46 that is pivotally supported relative to the cylinder block 28. Each swash plate 46 provides a piston-supporting surface 46A along which the plurality of pistons 42 of the corresponding pump unit slide during operation of the pump. To this end, each piston 42 can include a slipper or shoe 50 at the end of the piston 42 abutting the piston-supporting surface 46A of the swash plate 46. Although shown in FIGS. 5 and 6 in a neutral position in which the piston-supporting surface 46A defines an angle $\alpha$ of 90 degrees with respect to the central axis A (taken as a "swash plate angle" equal to zero), the swash plate 46 is pivotable relative to the central axis A in at least one direction from the neutral position. As shown, the swash plate 46 can rotate in two opposing directions from the neutral position, which acts to reverse the flow through the pump unit 20A, 20B. However, if unidirectional flow is acceptable, the swash plate 46 may only be rotatable in one direction from the neutral position. When the swash plate 46 is tilted to a position other than the neutral position, the angle $\alpha$ dictates a piston stroke that each piston 42 will traverse over the course of one rotation of the cylinder block 28 about the central axis A. This, in turn, defines the fluid displacement of the respective pump unit 20A, 20B. As described in further detail below, the swash plates 46 of the separate pump units 20A, 20B can be independently tilted to assume different swash plate angles to that the pump units 20A, 20B operate concurrently with different displacements, or one operates with a positive displacement while the other is held neutral. However, it is reiterated that the pump 20 can in other constructions include a single pump unit with a single swash plate 46. Tandem pumps as shown herein are useful in hydrostatic traction drive systems (e.g., for skid-steer vehicles), among other uses. In a hydrostatic traction drive vehicle, the first pump unit 20A is coupled to a hydraulic motor that turns at least one left-side wheel while the second pump unit 20B is coupled to a hydraulic motor that turns at least one right-side wheel, and turning of the vehicle is accomplished by setting a differential between left and right motor drive speeds by controlling pump displacement of the separate pump units 20A, 20B.

Each pump unit 20A, 20B can be arranged so that the pumped fluid flow into and out of the cylinder bores 32 is conducted into and out of the pump 20 through ports 56 that are positioned on a side of the swash plate 46 that is opposite the piston-supporting surface 46A. For example, each pump unit 20A, 20B can include a port block 54 having first and second pumping ports 56, while the housing 24 and the cylinder block 28 are provided without any pumping ports. To make this possible, fluid flow is established from a first pumping port 56 of the port block 54, through a port block connector passage 58 and a first fluid passage 60 in the swash plate 46, through respective bores through the shoes 50 and the pistons 42, to the plurality of cylinder bores 32, and then established from the plurality of cylinder bores 32, through the pistons 42 and the shoes 50, and through a second fluid passage 60 in the swash plate 46 and a second port block connector passage 58, to a second pumping port 56. Although flow-through, hollow structure of the pistons 42 and the shoes 50 cannot be seen in FIG. 6, this is merely due to the cross-section cut plane lying off-center.

The pumping ports 56 and the fluid passages 60 of the swash plate 46 are not uniquely identified as "inlet and outlet", or "high vs. low pressure" since the direction of pumped fluid and the resulting fluid pressure is not limited to one way. Rather, fluid in one of the pump units 20A, 20B will be pumped from a first one of the pumping ports 56 to the other of the pumping ports 56 when the swash plate angle is tilted to a positive value, and fluid will be pumped in the reverse direction when the swash plate angle is tilted to a negative value. Depending on the use of the pump 20, the flow direction may change frequently during operation. The fluid passages 60 through the swash plate 46 are arcuate in shape along the piston-supporting surface 46A. Based on the swash plate angle, when the swash plate 46 is not in the neutral position, the pistons 42 are continuously pressed farther and farther into the respective cylinder bores 32 as they slide along one of the fluid passages 60 in the swash plate 46. This sets the particular fluid passage 60 as the "outlet" or "high pressure side". The opposite fluid passage 60 will be the "inlet" or "low pressure side", and the pistons 42 are continuously retracted from the respective cylinder bores 32 as they slide along the arcuate inlet fluid passage 60. Each of the fluid passages 60 extends over an arc of slightly less than 180 degrees (e.g., more than 120 degrees and less than 180 degrees). A retaining plate (not shown) can be provided at the swash plate piston-supporting surface 46A to encompass each of the piston shoes 50 and keep the pistons 42 properly oriented against the piston-supporting surface 46A.

In order to maintain a charge pressure to the low pressure side of the pump units 20A, 20B and to make up fluid losses created by inefficiencies of the pump units 20A, 20B, a charge port 70 is provided in the pump housing 24. The charge port 70 is coupled to the pumping ports 56 of each of the pump units 20A, 20B via respective fluid passages 72 that extend through the pump housing 24 and through the respective port blocks 54. A charge pressure relief valve 74 is provided in fluid communication with the charge port 70 and the fluid passages 72. The charge pressure relief valve 74 is operable to open to relieve built-up fluid pressure to a fluid tank or reservoir maintained at a reservoir pressure (e.g., atmospheric) below the charge pressure. The fluid tank or reservoir can be provided internal to the pump 20 or as an external chamber. As shown, the internal cavities of the pump housing 24 and the port blocks 54 that are not in communication with the pump circuit provide all or part of the fluid reservoir. As less flow is used by the pump than is provided, pressure at the charge port 70 increases, and when a threshold value is reached, fluid is dumped to the reservoir through the charge pressure relief valve 74. Each pump unit 20A, 20B further includes two high pressure relief valves 78, including one positioned in fluid communication with each one of the pumping ports 56 and operable to respond to the fluid pressure at the respective pumping port 56, since any one of the pumping ports 56 can be the "high pressure side" depending upon the swash plate angle. Each high pressure relief valve 78 is operable to open when the fluid pressure at the outlet side pumping port 56 reaches a set threshold pressure, and when open, establishes fluid communication from the outlet pumping port 56 to the reservoir (e.g., through the charge fluid passages 72). Additionally, auxiliary measurement ports 82 can be provided in the port blocks 54, with one such port adjacent each pumping port 56 (e.g., along a fluid path between the pumping port 56, the high pressure relief valve 78, and the corresponding swash plate fluid passage 60). The auxiliary measurement ports 82 can accommodate a fluid pressure monitoring device, or can be routed with a hydraulic line to an external fluid pressure monitoring device.

Figure 6:
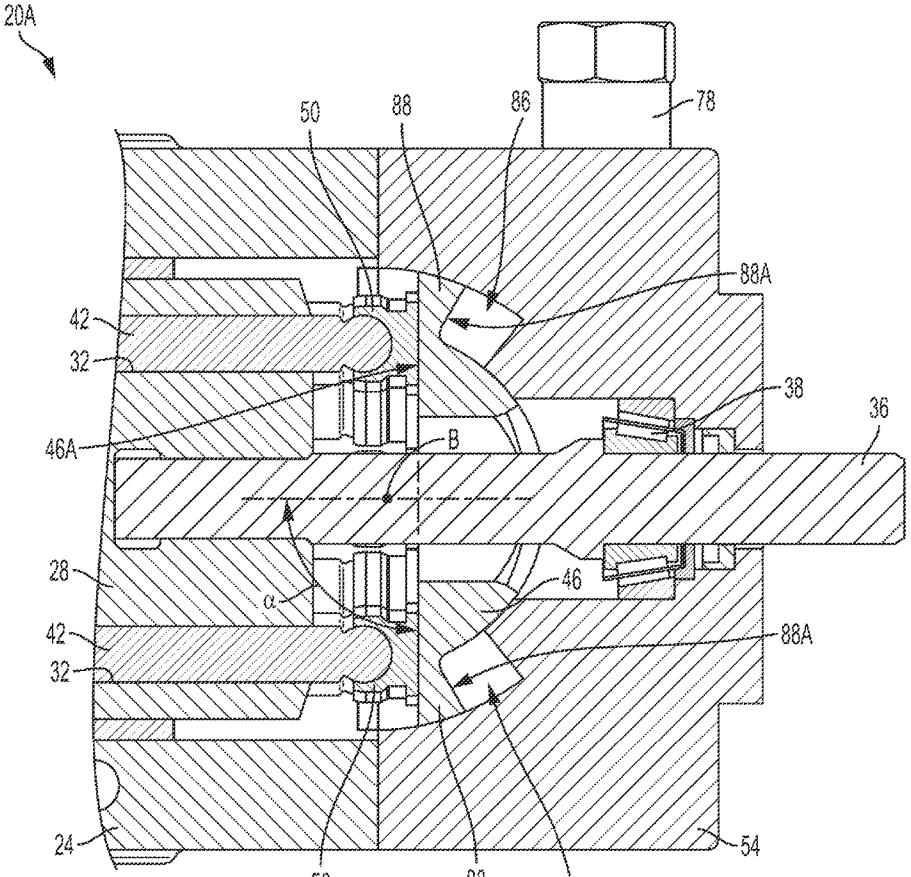
FIG. 6 is a cross-section view of the pump, taken along line 6-6 of FIG. 1.

As mentioned above, the swash plate 46 of each pump unit 20A, 20B can tilt or pivot relative to the central axis A. Alternately stated, the swash plate 46 can tilt or pivot with respect to the stationary pump components such as the pump housing 24 and the port blocks 54 and with respect to the cylinder block 28, which rotates in place during operation of the pump 20. The swash plates 46 are pivotable about respective swash plate axes B. Contrary to conventional variable displacement axial piston pumps, the pump 20 includes no control pistons to mechanically engage and move the swash plates 46. Rather, each swash plate 46 is directly fluid controlled by a variable hydraulic pressure. Each swash plate 46 partially defines at least one corresponding variable volume control chamber 86, and the swash plate 46 is operable to tilt in response to a fluid pressure change in the control chamber 86. As illustrated in FIG. 6, each swash plate 46 has two sides or flanks 88 that are positioned on opposite sides of the swash plate axis B. Each swash plate flank 88 defines a swash plate back surface 88A that is opposite the piston-supporting surface 46A. As shown in FIG. 6, the swash plate back surface 88A combines with a pocket 92 formed in the port block 54 to define the variable volume control chamber 86. Depending on the fluid pressure delivered to one or both control chambers 86, the swash plate 46 pivots (clockwise or counter-clockwise in FIG. 6) about the swash plate axis B, which is into and out of the page in FIG. 6. In this embodiment, each pump unit 20A, 20B includes two independent control chambers 86, however, an alternate construction can provide a single control chamber 86 on one side of the swash plate 46, and the swash plate 46 can be biased by an elastic member toward a position that puts the control chamber 86 to a minimum volume. In either case, the swash plate 46 is directly actuated by hydraulic fluid pressure on its back surface 88A as the mechanism for swash plate angle control during operation of the pump 20.

Figure 7:
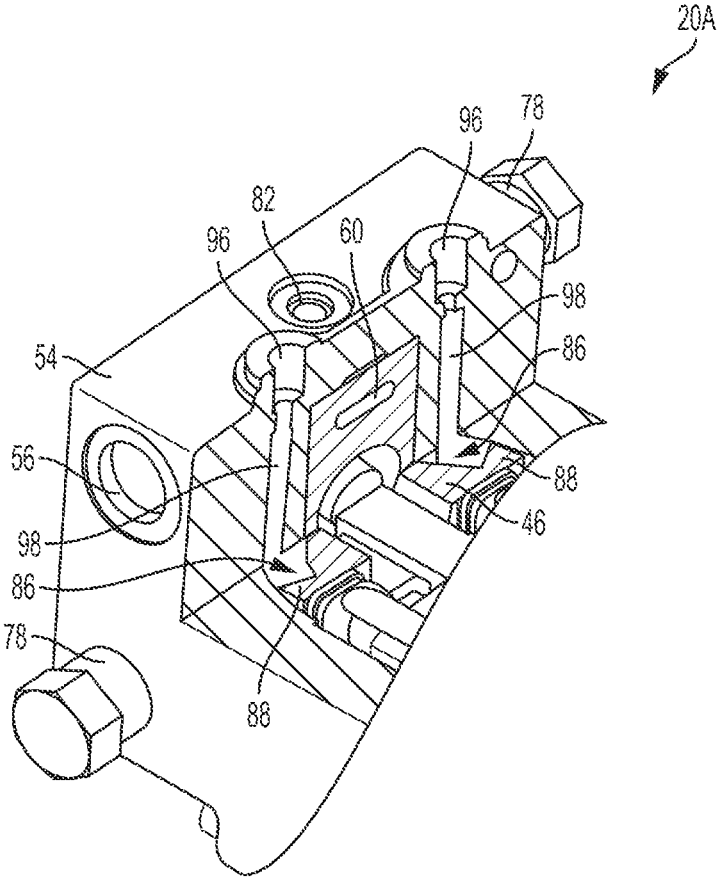
FIG. 7 is cross-section view of the pump, taken along line 7-7 of FIG. 1.
Figure 8:
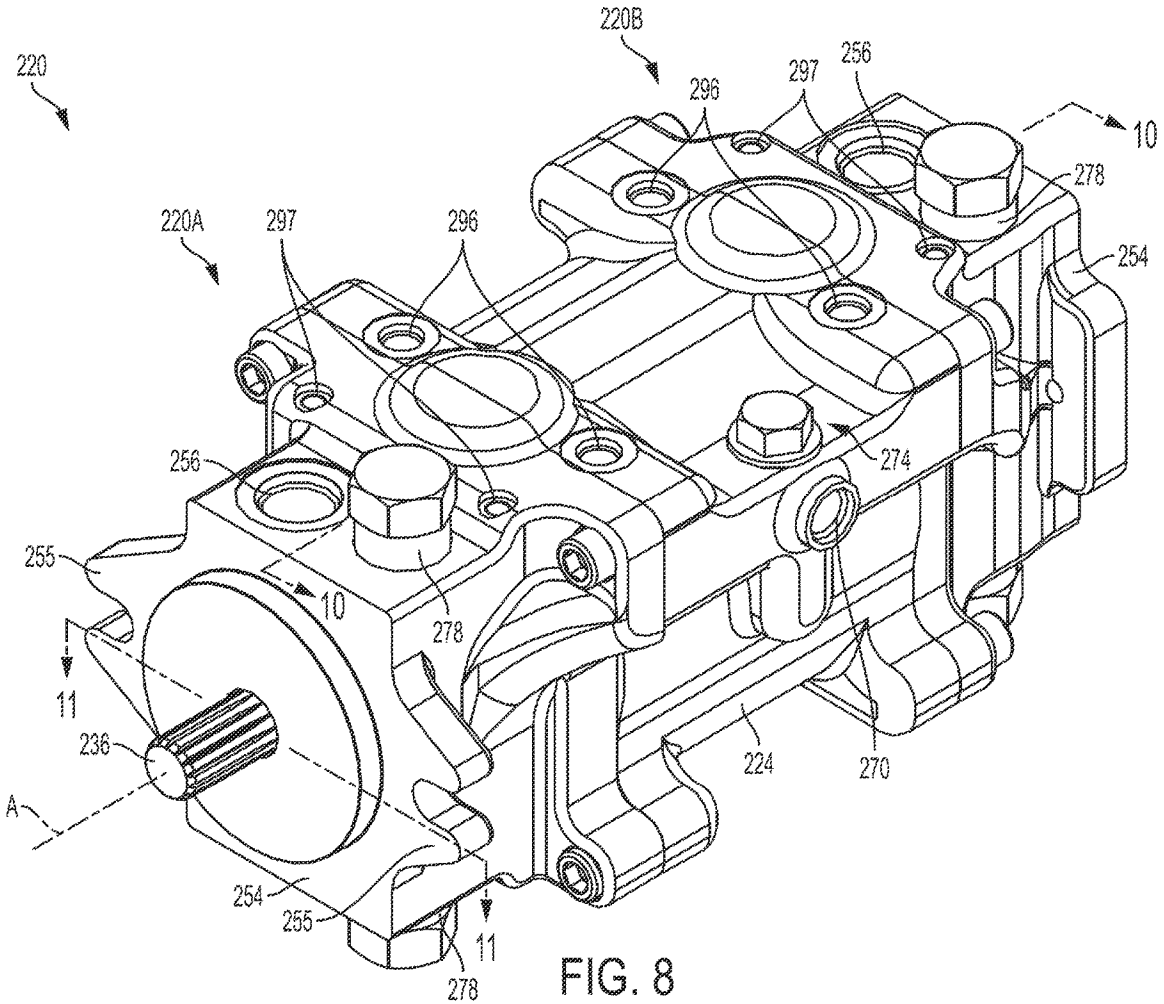
FIG. 8 is a perspective view of a variable displacement axial piston pump according to another exemplary construction.
Figure 9:
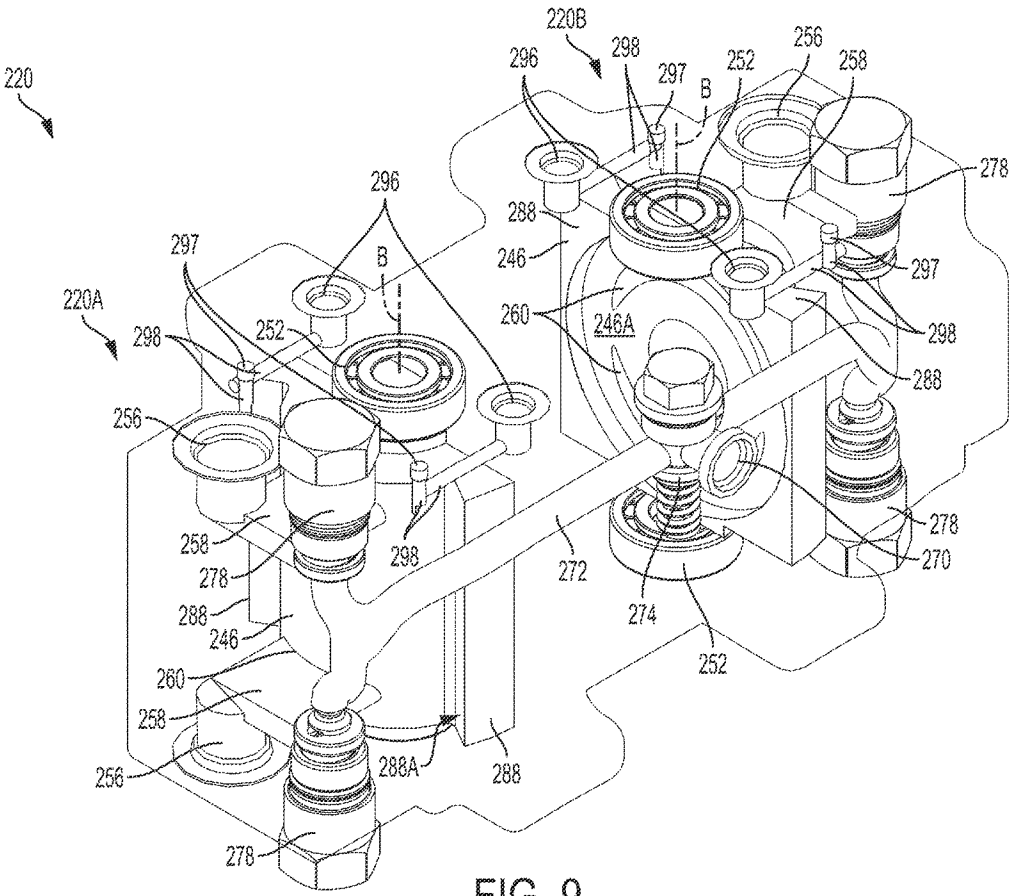
FIG. 9 is a perspective view of the pump of FIG. 8, in which the exterior material is made transparent and a majority of the pumping components are omitted so that the view instead shows a number of internal fluid passages.
Figure 10:
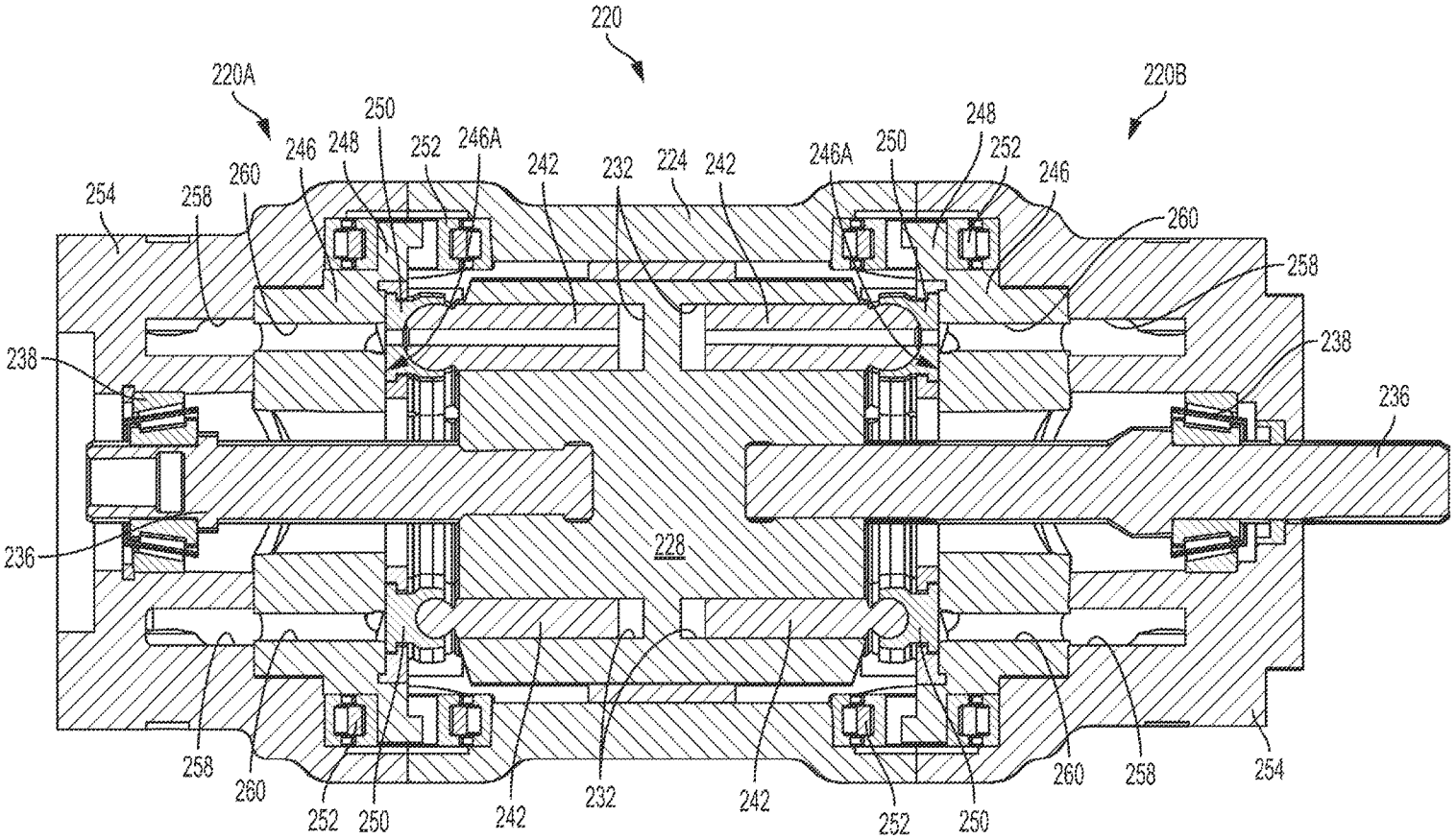
FIG. 10 is a cross-section view of the pump, taken along line 10-10 of FIG. 8.
Figure 11:
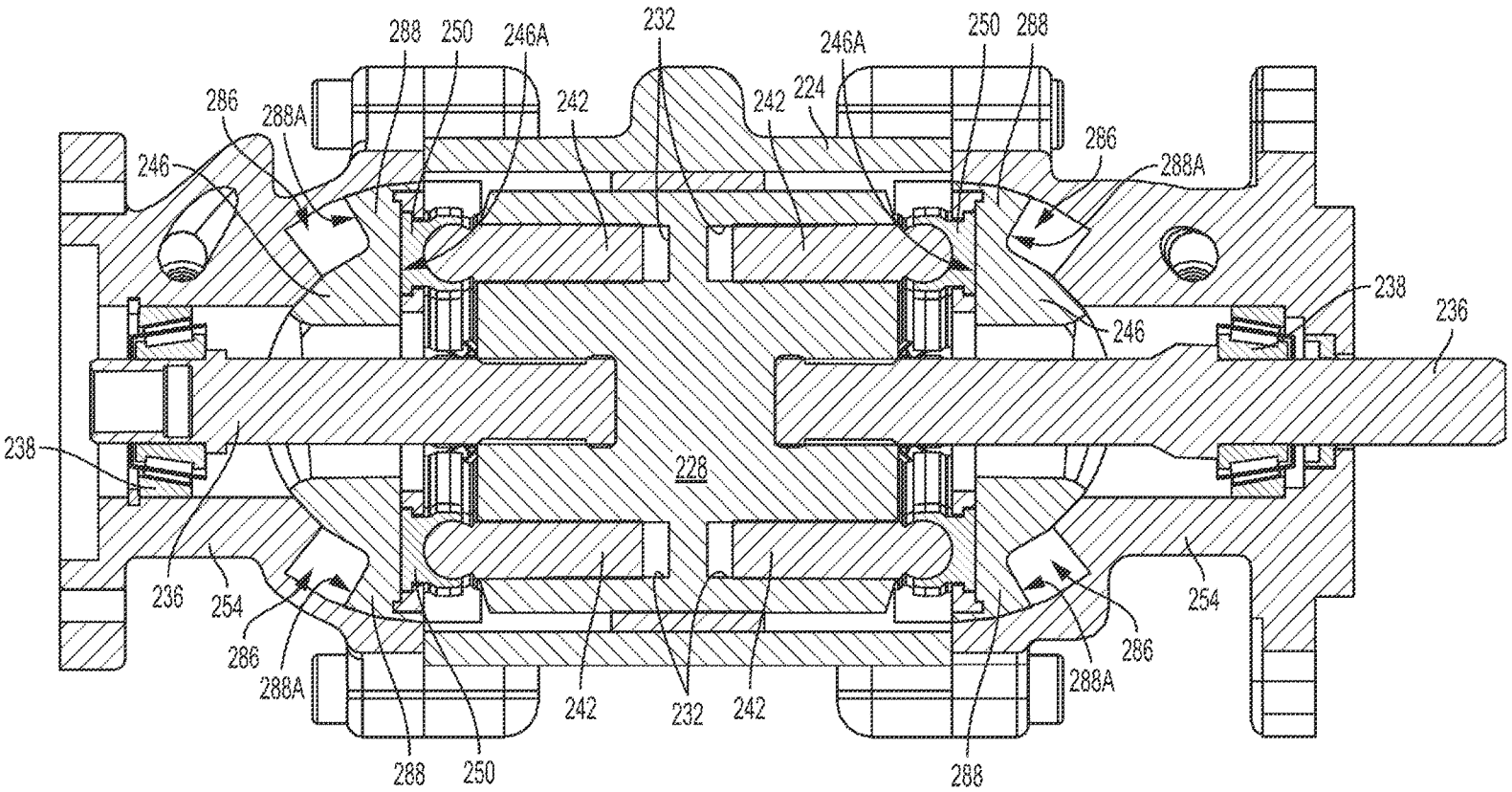
FIG. 11 is a cross-section view of the pump, taken along line 11-11 of FIG. 8.

Each control chamber 86 is in fluid communication with a corresponding pilot port 96 provided in the port block 54. Note that, unlike the other fluid passages and chambers inside the pump 20, the control chambers 86 are not depicted in FIG. 2 so that the swash plate 46 can be seen. As shown in FIG. 7, a control passage 98 fluidly couples the control chamber 86 to the pilot port 96. An external supply of hydraulic control fluid, separate from the pumped fluid, is supplied to each pilot port 96 according to a mechanical control element or an electronic controller to send hydraulic control fluid into the control chamber 86 at a desired pressure for achieving the desired swash plate angle. The control chamber 86 maintains fluid communication to the corresponding pilot port 96 via the control passage 98 throughout the full range of movement of the swash plate 46. When one control chamber 86 of a given swash plate 46 is to be actuated to push the swash plate 46, the opposite control chamber 86 of that swash plate 46 can be coupled to a low pressure (e.g., atmospheric) reservoir through the corresponding pilot port 96 to allow hydraulic control fluid to evacuate the control chamber 86 that is reduced in volume. The external control of hydraulic control fluid to the pilot ports 96 can be accomplished by any known means, including for example, external pumps and control valves.

FIGS. 8-11 illustrate a variable displacement axial piston pump 220 according to another embodiment. Many of the features and functions are similar to the pump 20 of FIGS. 1-7. Therefore, similar reference numbers are used (incremented by 200) and the description below focuses primarily on those features and functions that are unique to the pump 220. Reference is made to the above description for aspects of the pump 220 that generally conform to those of the pump 20, so that a repetitive description is avoided.

Like the pump 20 of FIGS. 1-7, the pump 220 of FIGS. 8-11 includes two pump units 220A, 220B and is constructed by mounting port blocks 254 to two opposing ends of a pump housing 224. However, the pump 220 as a whole provides an alternate packaging option compared to the pump 20, and at least one end of the pump 220 is provided with mounting tabs 255. Whereas each high pressure relief valve 78 of the pump 20 is provided across from the corresponding pumping port 56 (on opposite sides of the port block 54), each high pressure relief valve 278 of the pump 220 is provided directly next to the corresponding pumping port 256 (on a common side, and common exterior surface of the port block 254). As such, the two high pressure relief valves 278 for a given pumping unit 220A, 220B are both positioned to one side of a plane (e.g., plane 10-10) that extends along the central axis A. The two high pressure relief valves 278 for a given pumping unit 220A, 220B can also be positioned in line with one another as shown. As such, a majority portion of the charging circuit extending to the charge port 270 is formed by a single, common fluid passageway 272 to both the pair of high pressure relief valves 278. The overall extent of the charging circuit is reduced in length by the alternate layout of the pump 220 of FIGS. 8-11, and the charging circuit as a whole only occupies space on one side of the plane 10-10.

Furthermore, the pilot ports 296 are provided in the pump housing 224 rather than in the port blocks 254. Internal fluid passages couple the respective pilot ports 296 to the respective variable volume control chambers 286. Also, in contrast to the pump 20, all pilot ports 296 for both pump units 220A, 220B are provided on the same side of a central plane (e.g., plane 11-11) that extends along the central axis A. In other words, all of the pilot ports 296 open in a common direction from the pump 220. Additional access ports 297 formed in each port block 254 during manufacturing connect to the respective control passages 298 extending to the control chambers 286. However, these access ports 297 are blocked off or closed with plugs prior to the pump 220 being rendered complete for operation.

Each of the swash plates 246 of the pump 220 is provided with a pair of opposed stems or support shafts 248 that are supported by respective bearings 252. Although not shown in FIGS. 1-7, a similar feature can be provided in the pump 20 for supporting the swash plates 46. Though not discussed at great length herein, each pump unit 220A, 220B is operable to be varied in displacement, like in the pump 20 described above, by direct hydraulic fluid control to the swash plate flanks 288 that partially define the respective control chambers 286. No control pistons are provided to mechanically adjust the swash plates 246.

Figure 12:
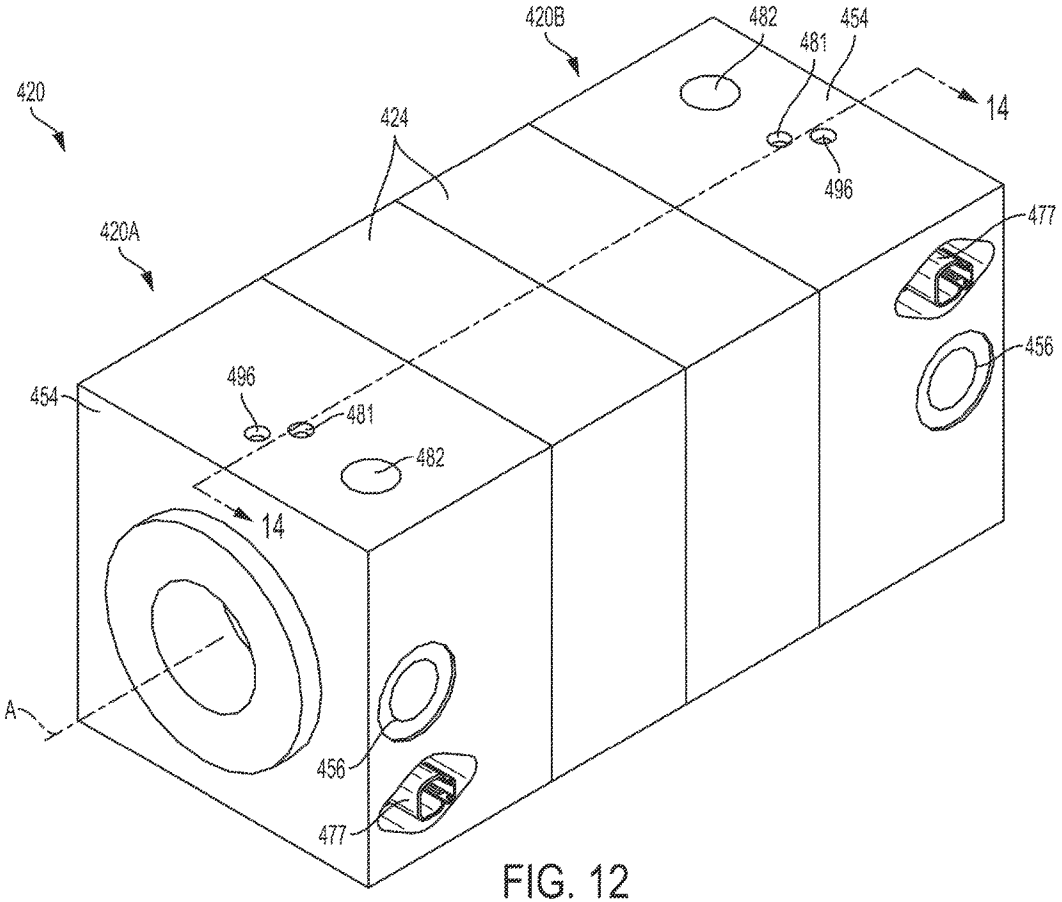
FIG. 12 is a perspective view of a variable displacement axial piston pump according to yet another exemplary construction.
Figure 13:
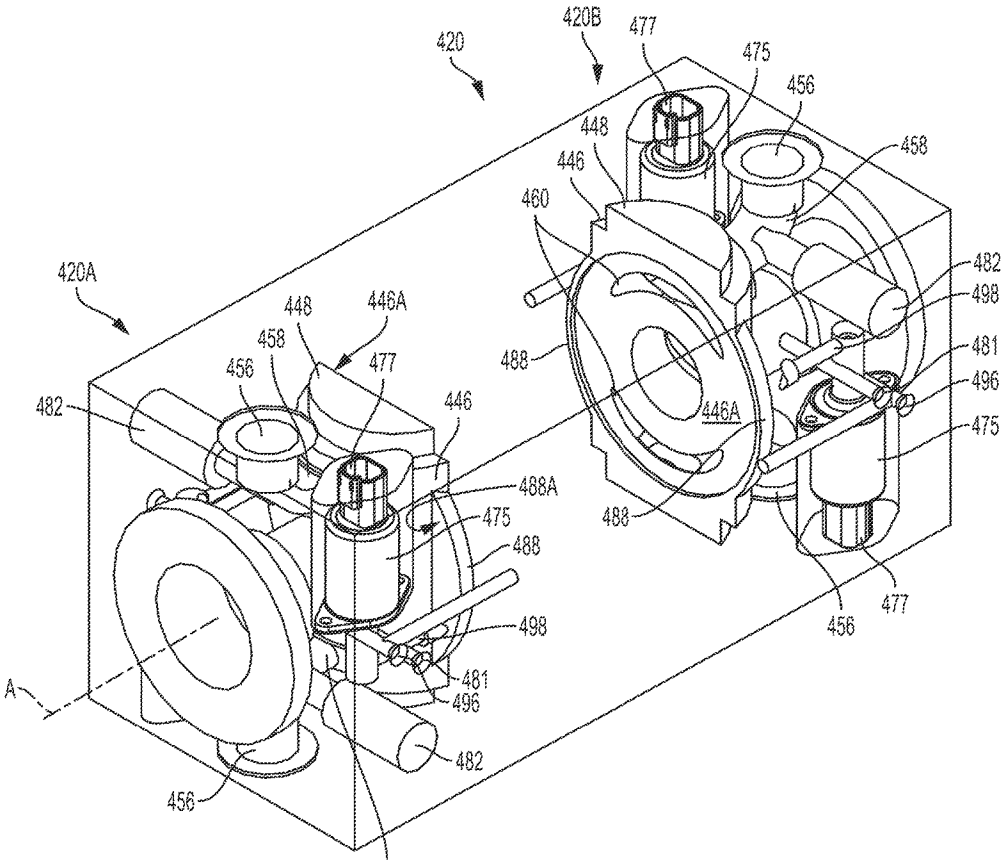
FIG. 13 is a perspective view of the pump of FIG. 12, in which the exterior material is made transparent and a majority of the pumping components are omitted so that the view instead shows a number of internal fluid passages.
Figure 14:
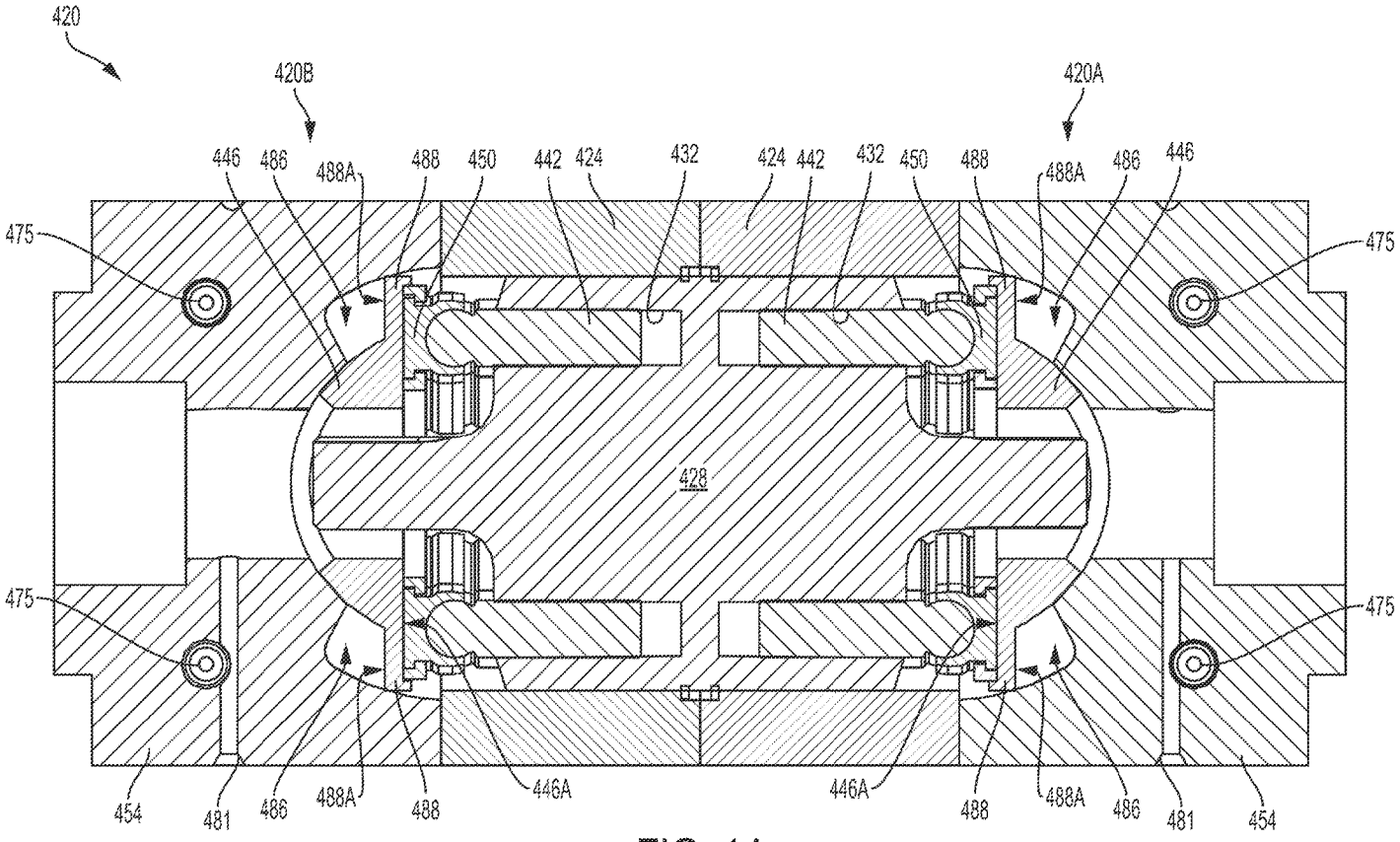
FIG. 14 is a cross-section view of the pump, taken along line 14-14 of FIG. 12.

FIGS. 12-14 illustrate a variable displacement axial piston pump 420 according to yet another embodiment. Many of the features and functions are similar to the pump 20 of FIGS. 1-7. Therefore, similar reference numbers are used (incremented by 400) and the description below focuses primarily on those features and functions that are unique to the pump 420. Reference is made to the above description for aspects of the pump 420 that generally conform to those of the pump 20, so that a repetitive description is avoided.

Like the pump 20 of FIGS. 1-7, the pump 420 of FIGS. 12-14 includes two pump units 420A, 420B and is constructed by mounting port blocks 454 to two opposing ends of a pump housing 424. However, the pump 420 as a whole provides an alternate packaging option compared to the pump 20, and the pump housing 424 may be provided as a two-piece housing between the two port blocks 454. The pump 420 includes a cylinder block 428 that receives two separate groups of pistons 442 in respective groups of cylinder bores 432 on opposite ends of the cylinder block 428, and each group of pistons 442 is displaced by a stroke amount that varies in relation to swash plate angle of the respective swash plates 446.

Although each pump unit 420A, 420B includes a pair of pilot ports 496 corresponding to the pair of variable volume control chambers 486, the pump 420 includes integrated control valves 475 for controlling a variable pressure admitted into the control chambers 486. For example, the control valves 475 can be electrically-controlled proportional solenoid valves. Each control valve 475 can include a variable position spool that is adjusted in response to a varying electrical signal. For example, the valve 475 can move through an operational range that establishes increasing amounts of fluid communication between the pilot port 496 and the respective control chamber 486, or the valve 475 can be cycled between open and closed positions to effectively control the degree of fluid communication between the pilot port 496 and the corresponding control chamber 486. When closed, each control valve 475 fluidly connects the corresponding pilot port 496 to the reservoir, internal and/or external, which is at low pressure (e.g., at atmospheric pressure). In this position, the control valve 475 may also fluidly connect the control chamber 486 to the reservoir. The control passage 498 extending from the control chamber 486 is supplied with fluid pressure from the pilot port 496 once the control valve 475 is actuated into an open position. The control signal and the corresponding opening movement of the valve spool of the control valve 475 operate to allow an increasing portion of the pilot pressure to charge the control chamber 486. Thus, in order to move the swash plate 446 of a given pump unit 420A, 420B to a desired swash plate angle, the control valves 475 of that pump unit are controlled to settings that allow expansion of one of the control chambers 486, as driven by direct control fluid pressurization against the swash plate 446, while fluid is allowed to evacuate from the other control chamber 486 to reservoir. The pump 420 is also provided with reservoir connection ports 481 adjacent each of the pilot ports 496. Although the pump 420 requires a supply of control fluid at pilot pressure to each of the pilot ports 496, hardware for manipulating the control pressure in each of the control chambers 486 (e.g., the control valves 475) is provided directly on-board the pump 420. A plug-type electrical terminal 477 can extend from each control valve 475 for connection with an electronic controller programmed to control the valve settings in response to input mechanisms that correlate to changing the displacement of the respective pump units 420A, 420B. As with the other pumps disclosed herein, these input mechanisms may in some cases be joysticks or other human-operated controls for driving, and optionally steering, a vehicle having hydrostatic drive.

Various features and advantages of the invention are set forth in the following claims.

What is claimed is:

1. A variable displacement axial piston pump comprising:

a pump housing;

a cylinder block defining a plurality of cylinder bores, the cylinder block defining a central axis about which the plurality of cylinder bores are arranged, wherein the cylinder block is supported for rotation relative to the pump housing about the central axis;

a plurality of pistons, each of the plurality of pistons being received in a respective one of the plurality of cylinder bores;

a swash plate pivotally supported relative to the cylinder block, the swash plate providing a piston-supporting surface along which the plurality of pistons slide during operation of the pump; and a port block defining first and second pumping ports arranged in fluid communication with the plurality of cylinder bores such that, during operation of the pump when the swash plate piston-supporting surface defines an angle other than 90 degrees with respect to the central axis, one of the first and second pumping ports is configured to supply fluid to the plurality of cylinder bores for pumping by the plurality of pistons as the cylinder block rotates, and the other of the first and second pumping ports is configured to receive fluid pumped from the plurality of cylinder bores by the plurality of pistons as the cylinder block rotates, wherein the swash plate partially defines at least one variable volume control chamber, and wherein the swash plate is operable to tilt with respect to the port block in response to a fluid pressure change in the at least one control chamber, and wherein the swash plate is arranged between the port block and the cylinder block and the at least one control chamber is defined jointly by the swash plate and the port block.

2. The variable displacement axial piston pump of claim 1, wherein the at least one control chamber is at least partially defined by a back surface of the swash plate that is opposite the piston-supporting surface.

3. The variable displacement axial piston pump of claim 1, wherein there is no control piston provided for physically manipulating the angle between swash plate piston-supporting surface and the central axis.

4. The variable displacement axial piston pump of claim 1, further comprising a control valve operable to receive fluid from a pilot pressure port and to selectively control the passage of fluid from the pilot pressure port to the at least one control chamber for setting the angle between swash plate piston-supporting surface and the central axis.

5. The variable displacement axial piston pump of claim 4, wherein the control valve is an electronically controllable solenoid valve defining a range of open positions.

6. The variable displacement axial piston pump of claim 1, wherein the at least one control chamber includes a first control chamber and a second control chamber independent of the first control chamber, the first control chamber being positioned adjacent a first end of the swash plate and the second control chamber being positioned adjacent a second end of the swash plate opposite the first end.

7. The variable displacement axial piston pump of claim 6, further comprising a first control valve and a second control valve, the first control valve being operable to control the admission of pressurized fluid to the first control chamber for tilting the swash plate in a first direction for pumping fluid from the first pumping port to the second pumping port with the plurality of pistons, and the second control valve being operable to control the admission of pressurized fluid to the second control chamber for tilting the swash plate in a second direction for pumping fluid from the second pumping port to the first pumping port with the plurality of pistons.

8. The variable displacement axial piston pump of claim 7, wherein the pump housing defines an internal fluid reservoir in fluid communication with both the first and second control chambers.

9. The variable displacement axial piston pump of claim 1, wherein the plurality of pistons, the swash plate, and the port block form a first pump unit, the axial piston pump further comprising a second independent pump unit including a second plurality of pistons received in a second plurality of cylinder bores of the cylinder block, a second swash plate, and a second port block.

10. The variable displacement axial piston pump of claim 9, wherein the second swash plate partially defines at least one variable volume control chamber, and wherein the second swash plate is operable to tilt with respect to the pump housing in response to a fluid pressure change in the at least one control chamber, independent of the at least one control chamber of the first pump unit.

11. The variable displacement axial piston pump of claim 1, wherein the swash plate includes a back surface opposite the piston-supporting surface, wherein the swash plate defines a first fluid passage extending through the swash plate from the piston-supporting surface to the back surface, the first fluid passage being fluidly coupled to the first pumping port, and wherein there are no fluid inlet ports on the cylinder block and there are no fluid outlet ports on the cylinder block.

12. A variable displacement axial piston pump comprising:

a pump housing;

a cylinder block defining a plurality of cylinder bores, the cylinder block defining a central axis about which the plurality of cylinder bores are arranged, wherein the cylinder block is supported for rotation relative to the pump housing about the central axis;

a plurality of pistons, each of the plurality of pistons being received in a respective one of the plurality of cylinder bores;

a swash plate pivotally supported relative to the cylinder block, the swash plate providing a piston-supporting surface along which the plurality of pistons slide during operation of the pump; and a port block defining first and second pumping ports arranged in fluid communication with the plurality of cylinder bores such that, during operation of the pump when the swash plate piston-supporting surface defines an angle other than 90 degrees with respect to the central axis, one of the first and second pumping ports is configured to supply fluid to the plurality of cylinder bores for pumping by the plurality of pistons as the cylinder block rotates, and the other of the first and second pumping ports is configured to receive fluid pumped from the plurality of cylinder bores by the plurality of pistons as the cylinder block rotates, wherein the swash plate partially defines at least one variable volume control chamber, and wherein the swash plate is operable to tilt with respect to the port block in response to a fluid pressure change in the at least one control chamber, and wherein the swash plate includes a back surface opposite the piston-supporting surface, and wherein the swash plate defines a first fluid passage extending through the swash plate from the piston-supporting surface to the back surface, the first fluid passage being fluidly coupled to the first pumping port.

13. The variable displacement axial piston pump of claim 12, wherein the swash plate defines a second fluid passage extending through the swash plate from the piston-supporting surface to the back surface, the second fluid passage being fluidly coupled to the second pumping port.

14. The variable displacement axial piston pump of claim 13, wherein each piston of the plurality of pistons is a hollow piston having an axial through bore.

15. The variable displacement axial piston pump of claim 14, further comprising a plurality of piston shoes, each of the plurality of piston shoes being coupled to a respective one of the plurality of pistons and being arranged to abut the piston-supporting surface of the swash plate, and wherein each shoe of the plurality of shoes defines a through bore that is in constant fluid communication with a respective piston axial through bore and intermittently establishes and breaks fluid communication with each of the first and second fluid passages of the swash plate as the plurality of pistons rotate with the cylinder block relative to the swash plate.

16. A variable displacement axial piston pump comprising:

a pump housing;

a cylinder block defining a plurality of cylinder bores, the cylinder block defining a central axis about which the plurality of cylinder bores are arranged, wherein the cylinder block is supported for rotation relative to the pump housing about the central axis;

a plurality of pistons, each of the plurality of pistons being received in a respective one of the plurality of cylinder bores;

a swash plate pivotally supported relative to the cylinder block, the swash plate providing a piston-supporting surface along which the plurality of pistons slide during operation of the pump; and a port block defining first and second pumping ports arranged in fluid communication with the plurality of cylinder bores such that, during operation of the pump when the swash plate piston-supporting surface defines an angle other than 90 degrees with respect to the central axis, one of the first and second pumping ports is configured to supply fluid to the plurality of cylinder bores for pumping by the plurality of pistons as the cylinder block rotates, and the other of the first and second pumping ports is configured to receive fluid pumped from the plurality of cylinder bores by the plurality of pistons as the cylinder block rotates, wherein the swash plate partially defines at least one variable volume control chamber, and wherein the swash plate is operable to tilt with respect to the port block in response to a fluid pressure change in the at least one control chamber, and wherein there are no fluid inlet ports on the cylinder block and there are no fluid outlet ports on the cylinder block.

17. A variable displacement axial piston pump comprising:

a cylinder block defining a plurality of cylinder bores;

a plurality of pistons, each of the plurality of pistons being received in a respective one of the plurality of cylinder bores, wherein each piston of the plurality of pistons is a hollow piston having an axial through bore;

a port block defining first and second pumping ports, one of the first and second pumping ports being configured to supply fluid to the plurality of pistons and the other of the first and second pumping ports being configured to receive fluid from the plurality of pistons;

a swash plate arranged between the port block and the cylinder block for supporting the plurality of pistons in sliding relationship along a piston-supporting surface, the swash plate defining first and second fluid passages operable to receive pumped fluid flow, the first fluid passage being permanently fluidly coupled to the first pumping port and in intermittent fluid communication with each of the plurality of cylinder bores through the respective piston axial through bores, the second fluid passage being permanently fluidly coupled to the second pumping port and in intermittent fluid communication with each of the plurality of cylinder bores through the respective piston axial through bores; and at least one variable volume control chamber defined between the swash plate and the port block, wherein the swash plate is operable to tilt with respect to the port block, for varying a stroke length of the plurality of pistons, in response to a fluid pressure change in the at least one control chamber.

18. The variable displacement axial piston pump of claim 17, wherein the at least one variable volume control chamber includes a first variable volume control chamber operable to expand for tilting the swash plate in a first direction from a neutral position for pumping fluid from the first pumping port to the second pumping port with the plurality of pistons, and a second variable volume control chamber operable to expand for tilting the swash plate angle in a second direction from the neutral position for pumping fluid from the second pumping port to the first pumping port with the plurality of pistons.

19. The variable displacement axial piston pump of claim 17, further comprising a control valve operable to receive fluid from a pilot pressure port and to selectively control the passage of fluid from the pilot pressure port to the at least one control chamber for setting the angle between swash plate piston-supporting surface and the central axis.

20. The variable displacement axial piston pump of claim 17, wherein the plurality of cylinder bores in the cylinder block are blind bores, only communicating with the first and second pumping ports through the first and second fluid passages of the swash plate.

* * * * *